US005878612A

United States Patent [19]

Mauer

[11] Patent Number: 5,878,612

[45] Date of Patent: Mar. 9, 1999

[54] ELECTROMAGNETICALLY ACTUATED LOCK

[75] Inventor: Gunter Mauer, Heiligenhaus, Germany

[73] Assignee: Mauer GmbH, Heiligenhaus, Germany

[21] Appl. No.: 891,652

[22] Filed: Jul. 11, 1997

[30] Foreign Application Priority Data

Jul. 18, 1996 [DE] Germany ..... 196 28 994.7

[51] Int. Cl.[6] ..... E05B 47/00

[52] U.S. Cl. ..... 70/279; 292/150; 70/283; 70/277

[58] Field of Search ..... 70/277, 279, 283, 70/333 R; 292/144, 143, 140, 165, 170, 150

[56] References Cited

U.S. PATENT DOCUMENTS

| | | | |
|---|---|---|---|
| 3,733,861 | 5/1973 | Lester | 70/277 |
| 4,570,466 | 2/1986 | Matthews | 70/99 |
| 4,656,852 | 4/1987 | Deschamps | 70/277 |
| 4,671,086 | 6/1987 | Fogleman et al. | 70/277 |
| 4,768,021 | 8/1988 | Ferraro | 70/63 |
| 4,788,838 | 12/1988 | Cislo | 70/63 |
| 4,807,455 | 2/1989 | Mauer | 70/277 |
| 4,929,003 | 5/1990 | McConnell | 292/150 |
| 4,984,441 | 1/1991 | Mauer | 70/278 |
| 5,216,909 | 6/1993 | Armoogam | 292/150 |

FOREIGN PATENT DOCUMENTS

| | | | |
|---|---|---|---|
| 0148701 | 7/1985 | European Pat. Off. | 70/283 |
| 228027 | 7/1987 | European Pat. Off. . | |
| 427188 | 5/1991 | European Pat. Off. . | |

*Primary Examiner*—Darnell M. Boucher
*Attorney, Agent, or Firm*—Edwin D. Schindler

[57] ABSTRACT

An electromagnetically actuated lock is disclosed, which includes a lock bolt with a turnpin. An electromagnet is used as a retaining magnet, the electromagnet including a controlling and locking mechanism for locking or releasing the lock bolt. A control slide moves a control cam, a locking slide has a turnway, and a cross slide is coupled to the electromagnet with the locking slide. In a particularly preferred embodiment, a handling mechanism is used for actuating the lock bolt and for driving the control slide moving the control cam, the cross slide coupled to the electromagnet and the locking slide, so that the turnpin of the lock bolt immerses in the turnway of the locking slide. In an alternative, preferred embodiment, a tumbler lock mechanism is used, instead of the handling mechanism, and includes a double-bit key, so that both a key and a coded command are required for opening the lock.

6 Claims, 10 Drawing Sheets

ELECTROMAGNETICALLY ACTUATED LOCK

BACKGROUND OF THE INVENTION

1. Technical Field of the Invention

The present invention relates to an electromagnetically actuated lock.

More particularly, the present invention provides an electromagnetically actuated lock, which is especially useful for containers retaining valuables. The actuated lock of the invention includes a bolt actuated by handling means, and further includes an electromagnet installed as a retaining magnet, with the electromagnet being able to lock, or release, the bolt via controlling and locking elements.

2. Description of the Prior Art

Electromagnetically actuated locks are generally known to the prior art, with European Patent Application No. 0,427,188 being one example thereof. The electromagnetically controlled lock for containers of valuables described in this prior art citation has an electromagnet mounted in a casing, with the electromagnet being opposed by an armature supported on a locking lever. The latter, which is shaped in a complex manner, is coupled, via a support pin, control cams and a spring with a control lever having a turnway. Additionally, provision is made for a locking slide, which supports a turnpin engaging the control lever. Locking or releasing by motions of swiveling requires an exact cooperation between magnetic retaining forces, control cams, control pins, springs and a turnpin. The various components of this prior art lock are required to have minimal support clearance and little wear, as failure of the lock can be caused due to canting.

European Patent Application No. 0,228,027, likewise, relates to an electromagnetically controlled lock for containers for valuables, with a casing wherein, in addition to a customer locking mechanism, a bank locking mechanism is accommodated on the front side opening of the casing. An electromagnet is accommodated in a rear side recess of the casing. A locking lever and a control lever are accommodated beneath the main bolt and, therefore, are relatively difficult to access. The locking lever supports a magnetic armature, which is opposed by the yoke of the electromagnet. In this prior art locking mechanism, as well, cooperation between the magnet, control lever, locking lever and turnpin is quite complex, whereby narrow manufacturing tolerances are required so as to permanently assure proper functioning.

SUMMARY OF THE INVENTION

It is, therefore, an object of the present invention to provide an electromagnetically actuated lock having fewer required component parts that are easily manufactured, and having a reliability which does not require tolerances as exacting as those required by the prior art in order to properly function.

It is a further object of the present invention to provide an electromagnetically actuated lock requiring a low current consumption and having a long useful life.

The foregoing and related objects are accomplished by the electromagnetically actuated lock of the present invention, which includes handling means, which in addition to the locking bolt, drives a control slide which, in turn, drives a cross slide via an electromagnet. The electromagnet is coupled with a locking slide, with the turnpin of the bolt immersing in the turnway of the locking slide. The control slide, the cross slide and the locking slide are each coordinated with the magnetic parts of the lock so that, in a resting state, the magnetic armature rests against a yoke and a coil of the electromagnet. When the control movement starts, the cross slide is lifted, whereby it drives the locking slide when a current pulse is applied. When the magnet is currentless, the cross slide moves away from the locking slide, so that the locking slide remains in the locking position.

The electromagnet, consequently, is not required to perform any lifting work, in any case, so that a very small magnet, with a very low exciting current, suffices.

In its basic embodiment, the lock of the present invention is designed so that only unlocking is dependent upon the presence of an electric pulse. However, there are instances of application where, for example, in the field of hotels, where accidental or unintended locking of the container for valuables is to be prevented.

While, in the basic embodiment of the present invention, the turnway is designed so that the turnpin rests in it when the bolt is open, provision is made in a further embodiment of the invention wherein the turnpin exits from the turnway at the end of its opening path, so that the locking slide can again drop into the locking position.

In yet another advantageous embodiment of the present invention, a tumbler lock mechanism package is installed, in addition to the electromagnetically controlled lock. In such a case, the handling means of the invention is replaced, for example, by a double-bit key, so that parts of the key bit drive both the bolt and the control slide.

Accordingly, the term "handling means" is to be understood as comprising double-bit keys or cylinder keys, as well. Of decisive importance is that the torque from driving the control elements and the bolt is built up by hand, so that the current for the lock can be supplied for an extended period of time by a small, favorably-priced battery.

Other objects and features of the present invention will become apparent when considered in combination with the accompanying drawing figures which illustrate certain preferred embodiments of the present invention, in which a preferred embodiment of the electromagnetically actuated lock of the invention, requiring a current pulse both for opening and closing, is explained below and illustrated in FIGS. 1–16 of the accompanying drawing. A locking slide, for yet another embodiment of the present invention, for which a pulse is required only for opening the lock, is also discussed below and illustrated in FIG. 17 of the drawing. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
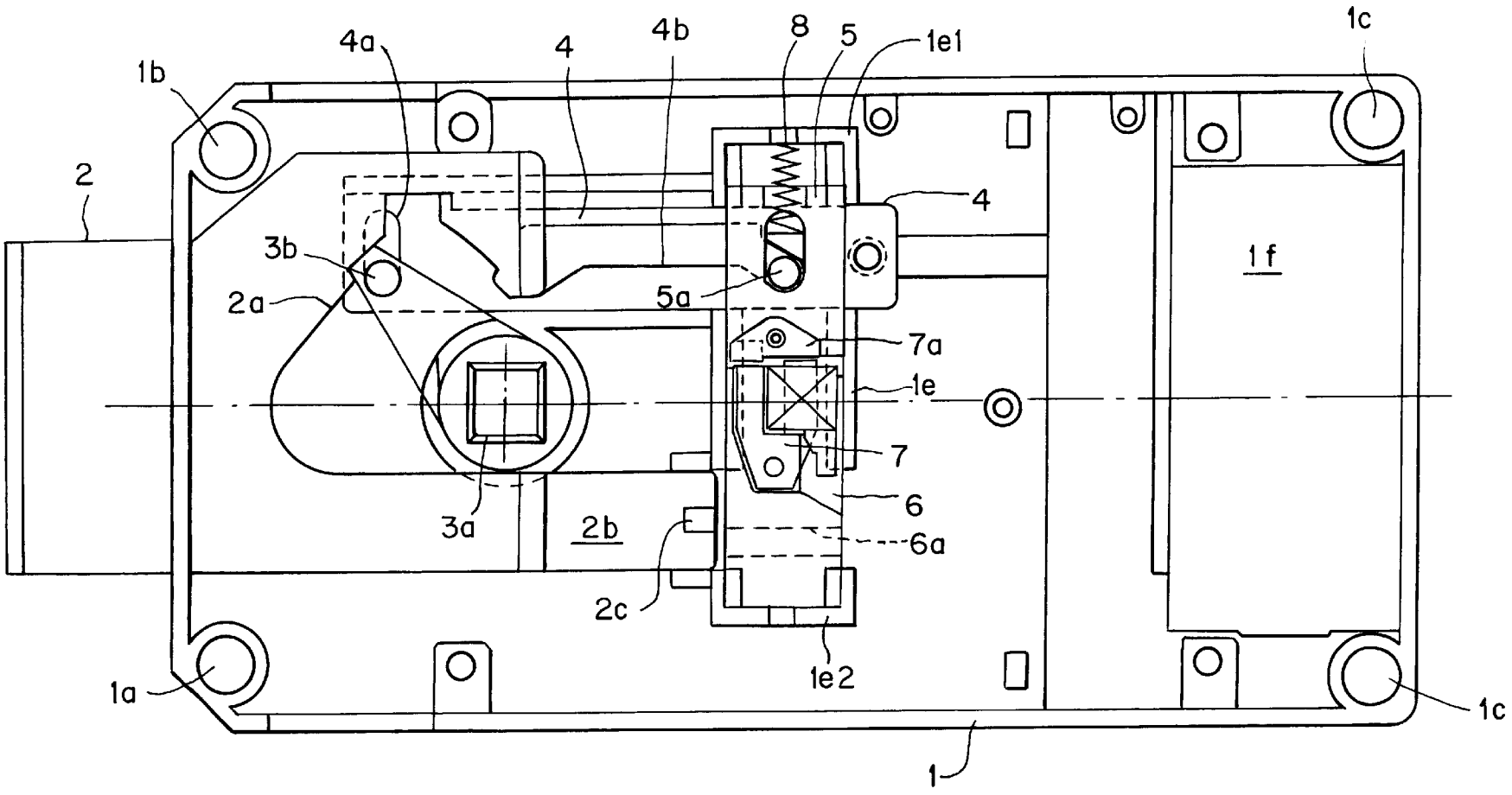
FIG. 1 is a plan view illustrating the electromagnetically actuated lock of the present invention in its locking position.

Turning now, in detail, to an analysis of the drawing figures, in FIG. 1, reference numeral 1 denotes the lock casing, which preferably comprises a pressure die casting or fiber-reinforced injection-molded thermoplastic. In the four corners of the broad stone-shaped casing, provision is made for screw holes 1*a*, 1*b*, 1*c*, 1*d*. Bolt 2 is shown displaceably supported in the left-half side of casing 1. Bolt 2 has a control recess 2*a*, in which swivel 3 immerses; the latter being actuated via a square hole 3*a* by handling means not shown. An arm 2*b* of the bolt 2, such arm extending to the right, supports a broad stone-like turnpin 2*c*.

A control slide 4 is displaceably supported beneath bolt 2. Control slide 4 moves in the same direction as bolt 2, driven via a pin 3*b* on swivel 3, with said pin immersing in an oblong hole 4*a*. Control slide 4 has a long-drawn control cam 4*b* driving a cross slide 5. The slide supports a pin 5*a*, which scans control cam 4*b*. A light screw spring 8 presses slide 5 downwardly, and pin 5*a* against control cam 4*b*. A locking slide 6 is supported beneath cross slide 5. Both slides are disposed in a recess 1*e* of the casing, with their movements being limited by stop surfaces 1*e*1, 1*e*2.

Locking slide 6 has a turnway 6*a* shown by broken lines; turnpin 2*c* is capable of entering said turnway when positioned correctly.

An electromagnet 7 is mounted on locking slide 6; said electromagnet being opposed by an armature 7*a* on cross slide 5.

FIG. 1 illustrates all parts of the inventive lock in the locking position.

When an attempt is made to retract bolt 2 by turning swivel 3 to the right, control slide 4 is first pushed to the right, causing cross slide 5 to be lifted.

Figure 2:
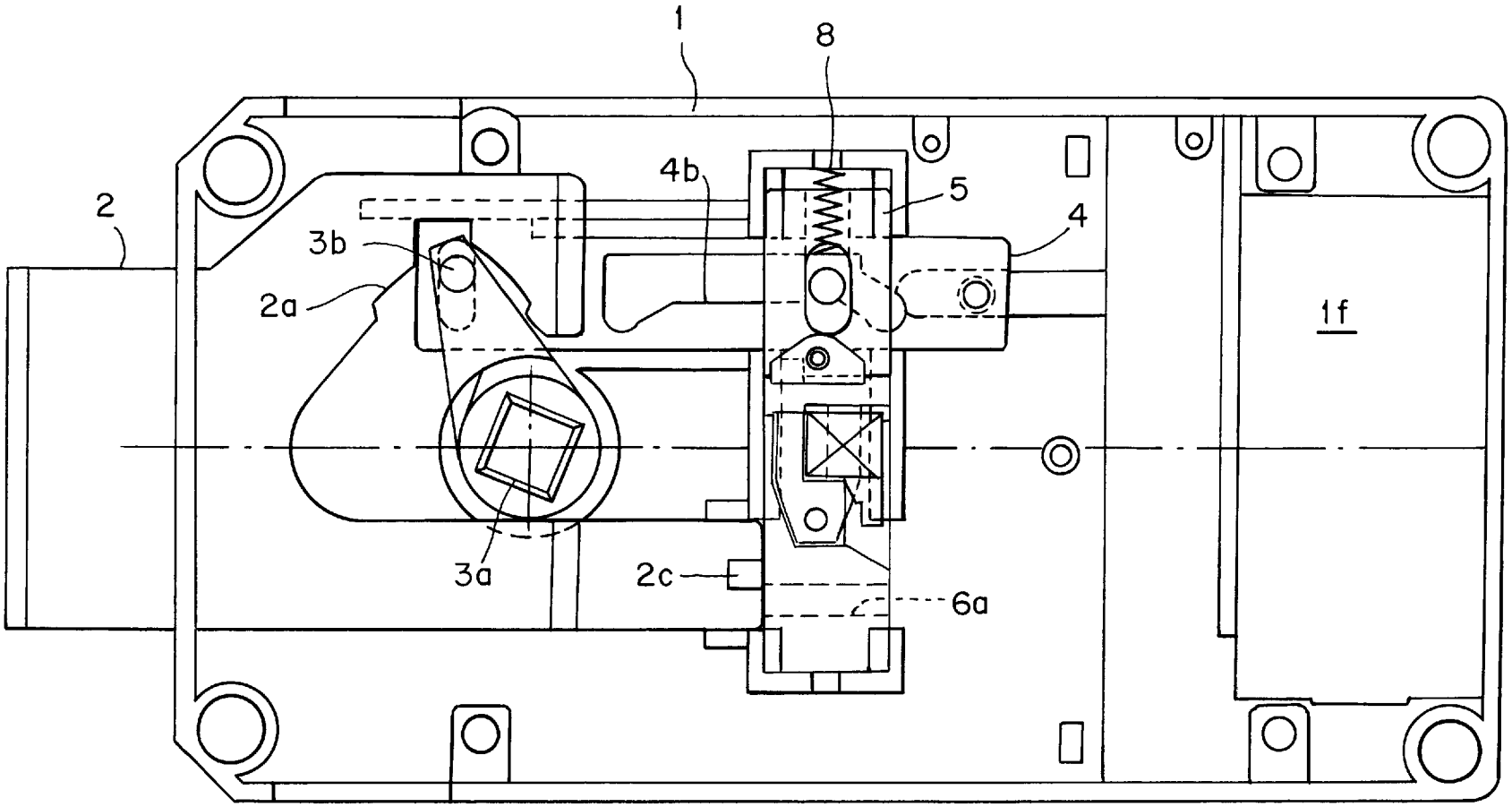
FIG. 2 is a plan view showing an attempt to open the lock of FIG. 1 without a current pulse.

When electromagnet 7 is currentless, armature 7*a* is lifted from the yoke of electromagnet 7, as shown in FIG. 2.

Locking slide 6 remains in the resting position and turnpin 2*c* impacts the surface of locking slide 6. The rotary motion of the handling means is consequently limited after a short control path, and bolt 2 remains in the extended position.

Figure 3:
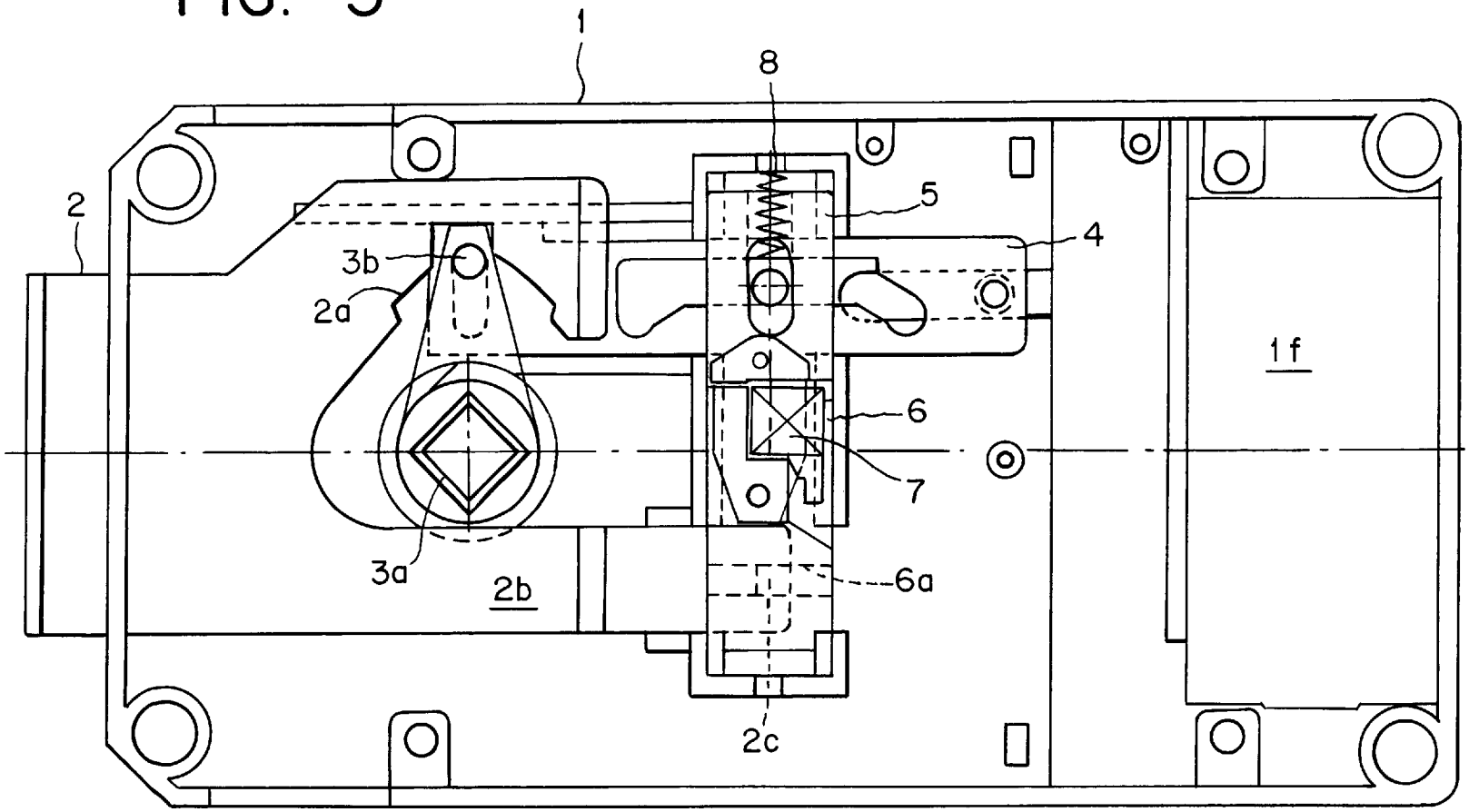
FIG. 3 is a plan view illustrating the opening process with the lock bolt retracted in a half-way position.

FIG. 3 shows the opening process of the lock of the invention, which is initiated when electromagnet 7 is excited and then moves the handling means. Armature 7*a* is retained by electromagnet 7, so that cross slide 5 drives locking slide 6. The locking slide 6 is lifted to exactly the extent necessary so that its turnway 6*a* faces turnpin 2*c*.

Figure 4:
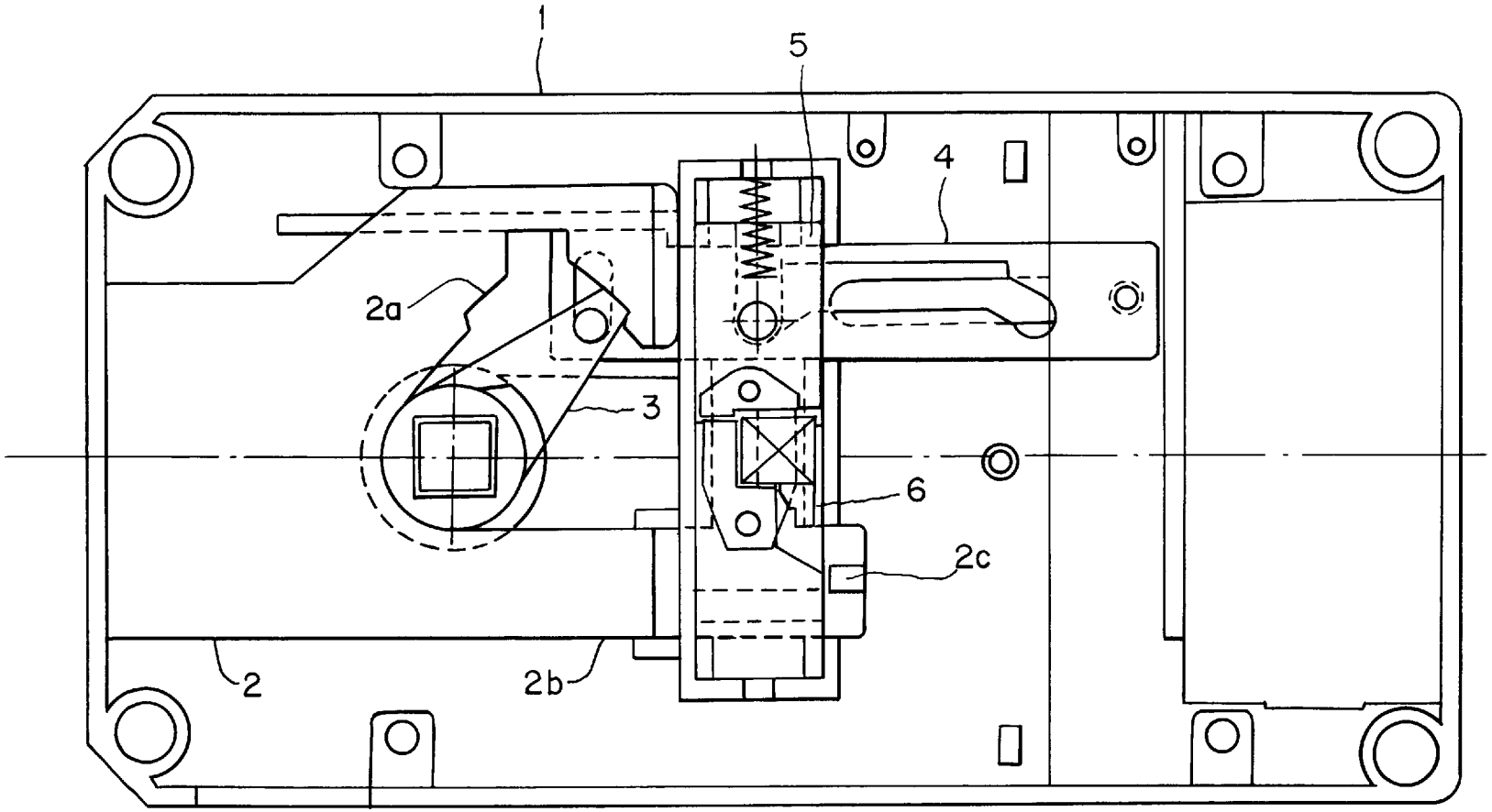
FIG. 4 is a plan view showing the open-position of the lock of the present invention with the bolt arrested.

Following the transition phase shown in FIG. 3, the bolt reaches its final position shown in FIG. 4, in which turnpin 2*c* has exited from the right-hand end of turnway 6*a* and locking slide 6 again assumes its lower end position and, thus, its arresting position.

Figure 5:
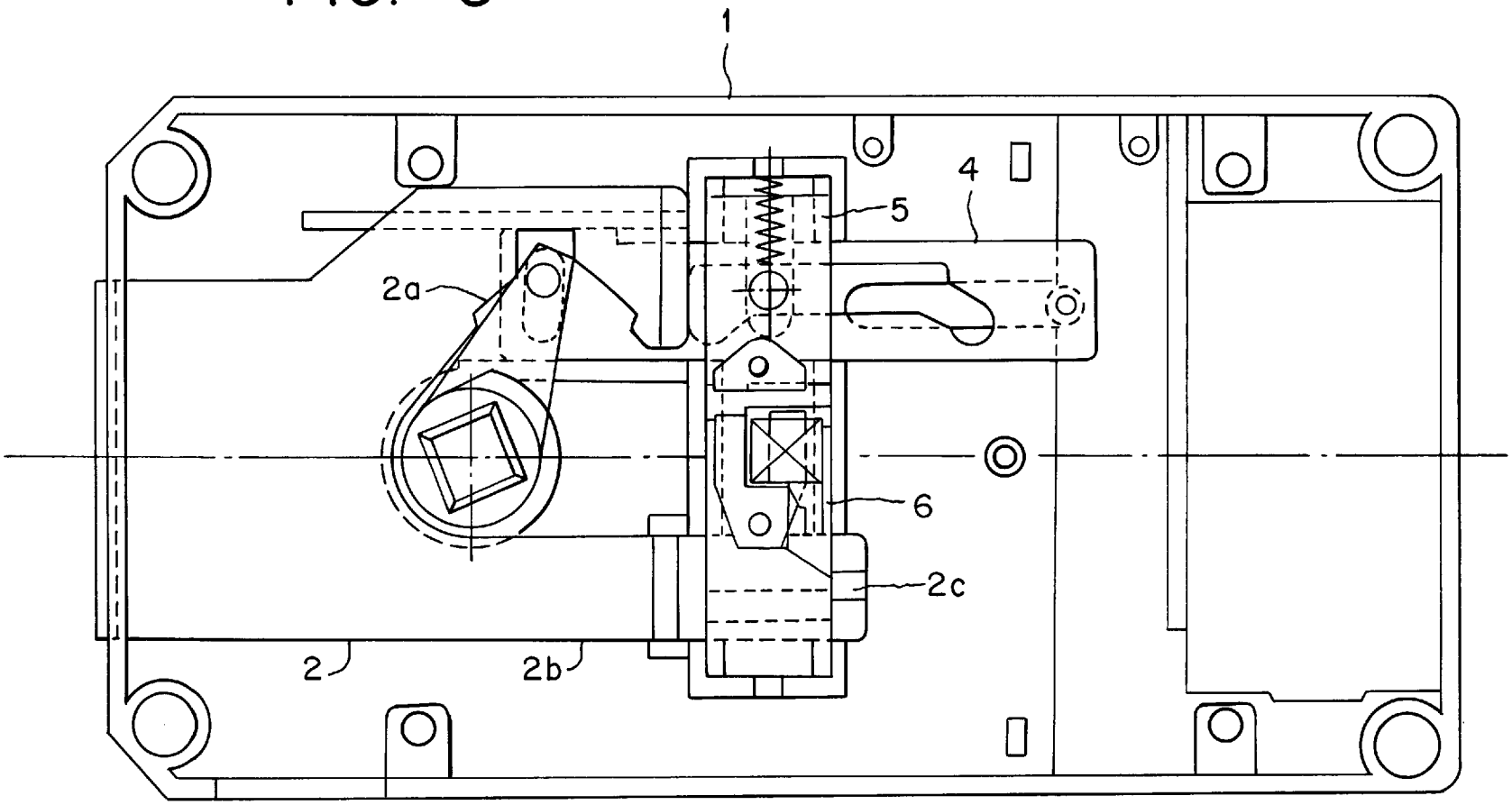
FIG. 5 is a plan view illustrating an attempt to extend the lock bolt with a current pulse.

Now, when swivel 3 is turned to the left, as shown in FIG. 5, control slide 4 is driven as well, lifting cross slide 5, whereby locking side 6 retains its blocking position when no current is admitted to the magnet. Turnpin 2*c* knocks against locking slide 6 and bolt 2 remains blocked in the unlocking position.

Figure 6:
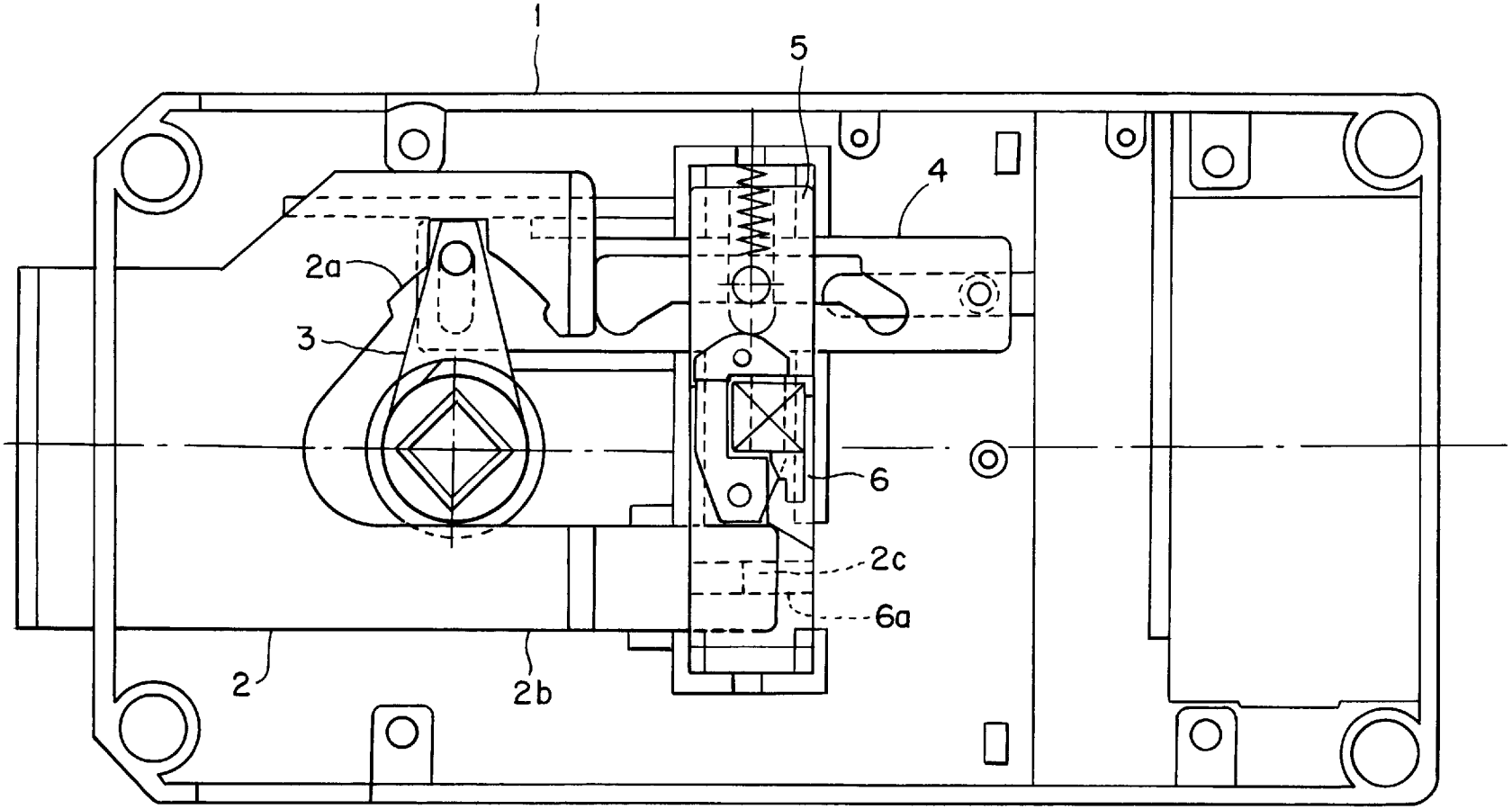
FIG. 6 is a plan view showing the extension of the bolt of the lock in FIG. 5 upon an application of an actuating current pulse.

FIG. 6 shows locking of the container for valuables when a current pulse is applied. Locking slide 6 is coupled with cross slide 5; turnpin 2*c* passes through turnway 6*a*, and bolt 2 can be fully extended. In its final position, turnpin 2*c* exits from turnway 6*a*; locking slide 6 drops down and the container is safely locked.

The condition of the lock then corresponds, again, with that shown in FIG. 1.

Figure 7:
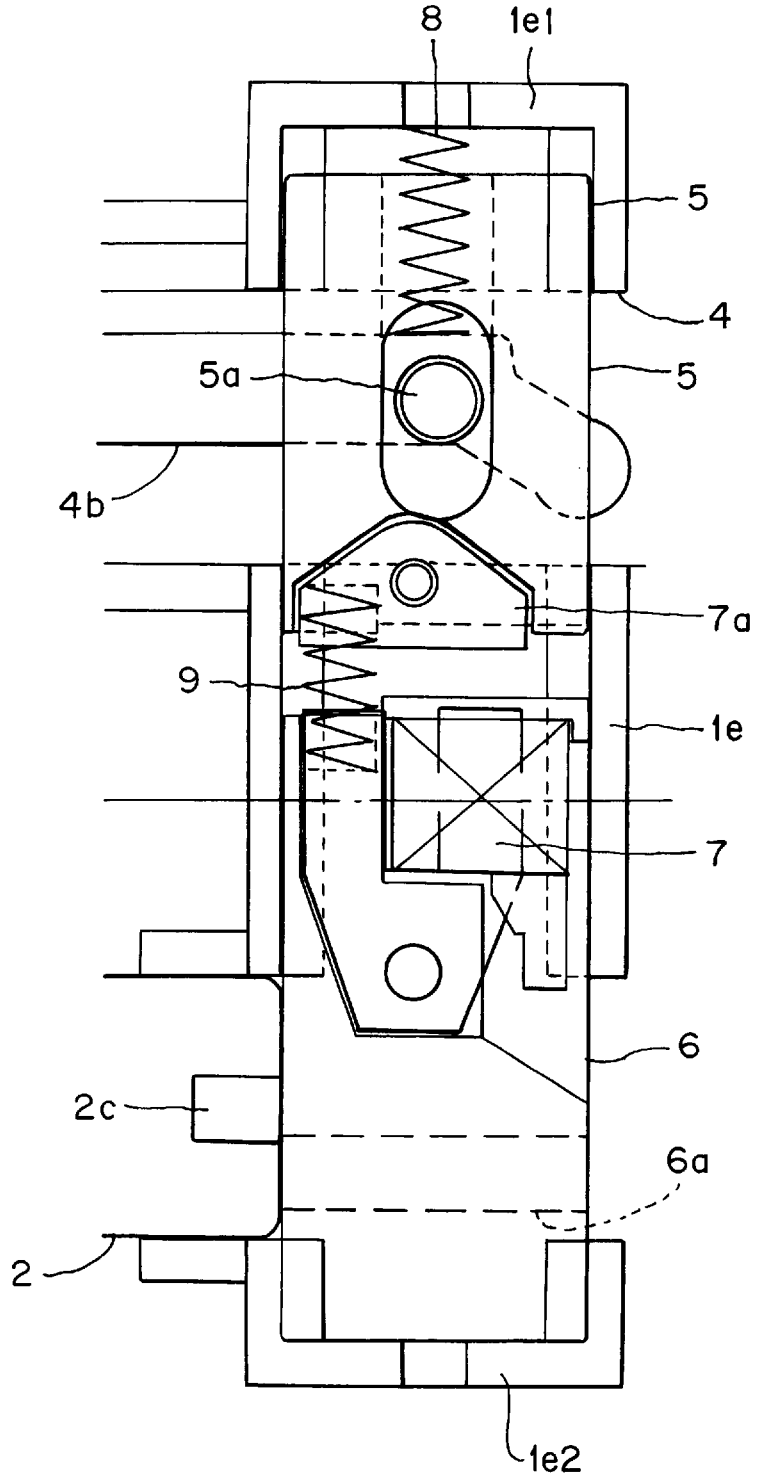
FIG. 7 illustrates the control elements of the electromagnetically actuated lock of the present invention enlarged, as a cut-out from FIG. 2.

The control elements are shown, in enlargement, in FIG. 7, which illustrates the control slide 4, with the control cam 4*b* of the latter pressing the cross slide 5 upwardly via pin 5*a*. Screw spring 8 assures that pin 5*a* rests on control cam 4*a*. A second, very light screw spring 9 is disposed between locking slide 6 and cross slide 5. Slides 5, 6 are supported in recess 1*e* of casing 1 and are easily movable in said recess, with the upward movement being limited by stop surface 1*e*1, and the downward movement by surface 1*e*2.

Figure 8:
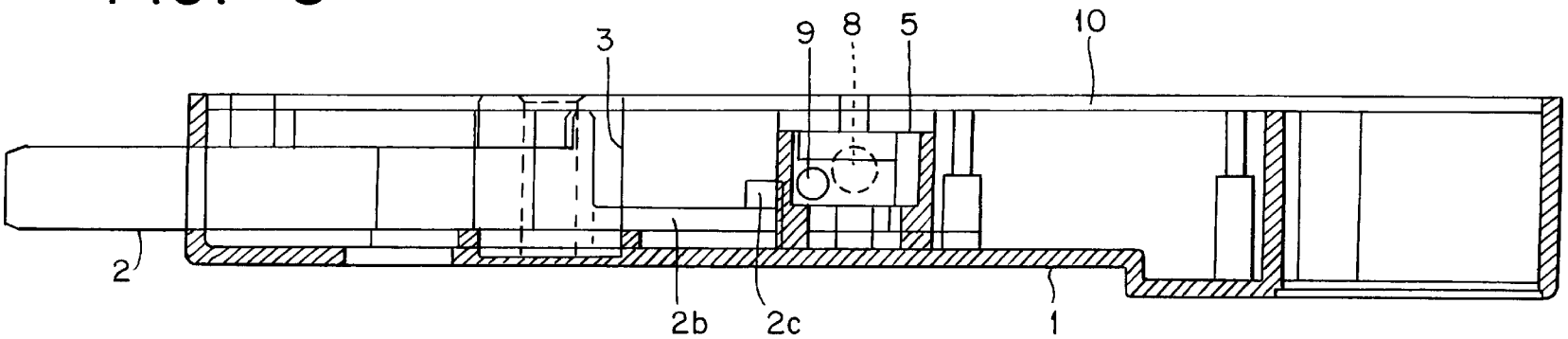
FIG. 8 is a longitudinal sectional view through the lock of the present invention.

FIG. 8 shows a longitudinal section through the novel lock. More particularly, FIG. 8 shows, in casing 1, the bolt 2 with arm 2*b*, the turnpin 2*c*, the cross slide 5, and the screw springs 8, 9. The operating parts in casing 1 are protected by a casing ceiling 10. Swivel 3 is guided at the bottom, on the bottom of the casing, and at the top, in casing ceiling 10.

Figure 9:
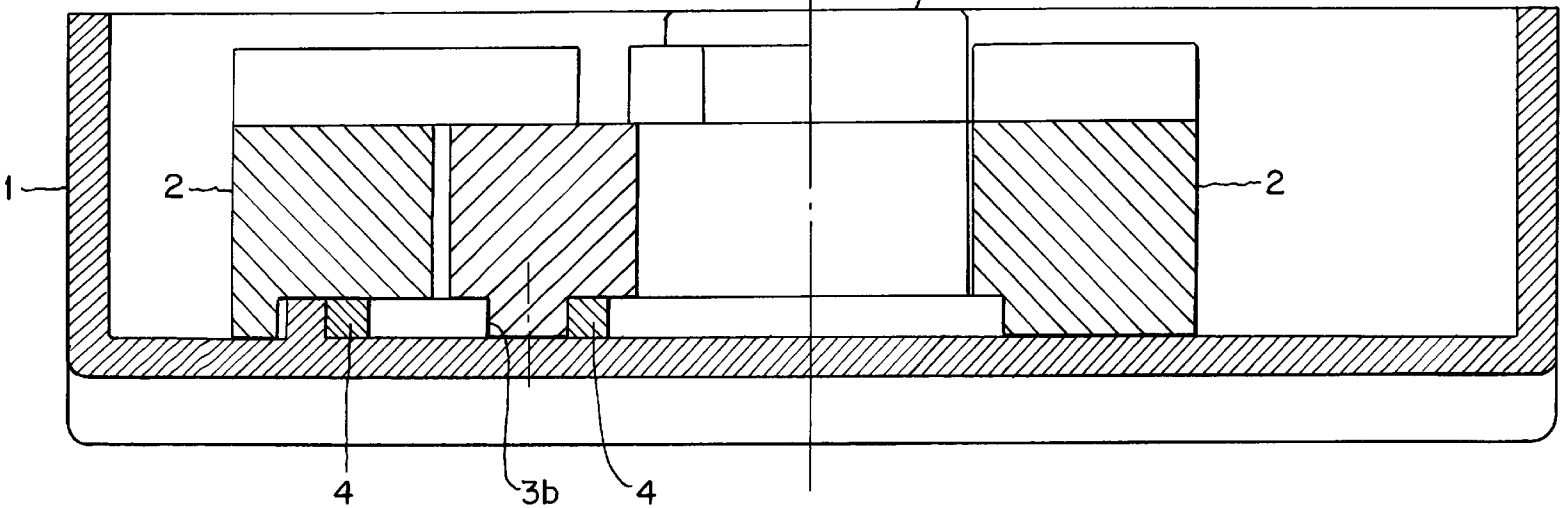
FIG. 9 is a cross-sectional view through the lock of the present invention.

FIG. 9 shows a cross-sectional view through the lock. Bolt 2 is supported in casing 1. Swivel 3, with pin 3*b*, the latter being in contact with control slide 4, is disposed in the center.

Figure 10:
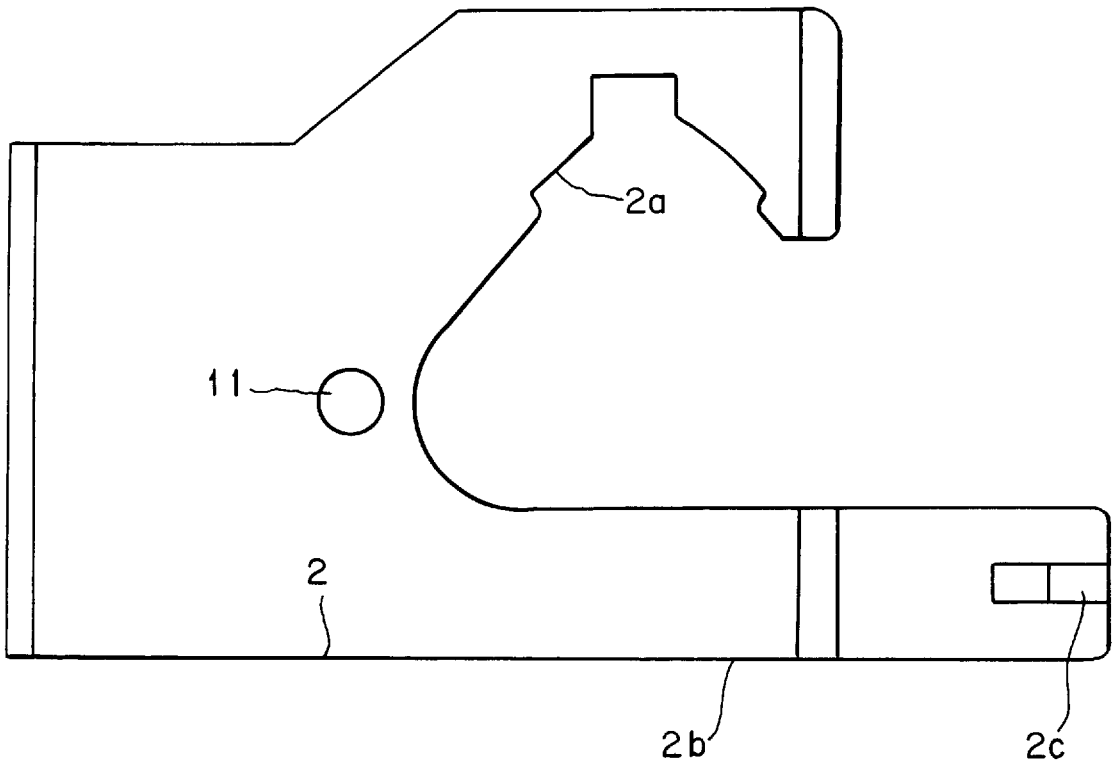
FIG. 10 is a top view of the bolt of the lock of the present invention.

FIG. 10 shows an enlarged view of bolt 2, with control recess 2*a*, arm 2*b* and turnpin 2*c*.

Control recess 2*a* is designed so that swivel 3 has a given amount of idle run. In this phase of movement, the control slide queries the control condition of the lock. If the magnet is excited, the opening or locking process can be executed.

If no actuating pulse is available, the handling means is stopped after a short angular movement, whereby the force for the control processes is intentionally applied via the handling means, so that the electromagnet is not required to perform any lifting work. Consequently, only very low retaining current is needed, which can be readily supplied by a standard multi-cell battery. Such a battery can be easily accommodated in a compartment 1*f* of the casing.

Figure 11:
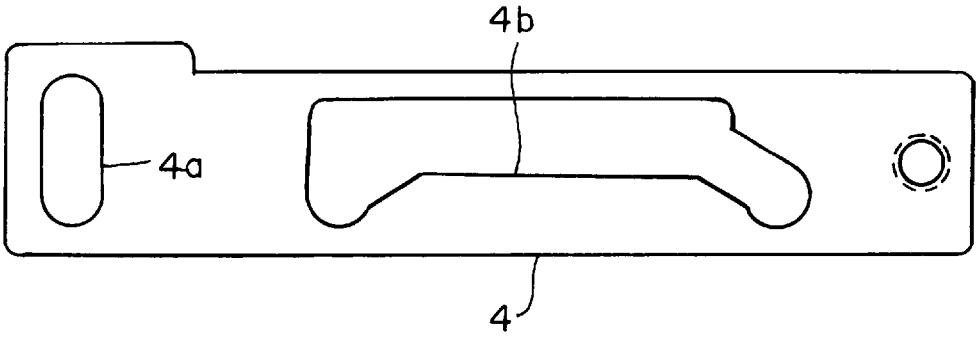
FIG. 11 is a plan view showing the control slide of the inventive electromagnetically actuated lock.

FIG. 11 shows the control slide 4 with the slotted hole 4*a* and the control cam 4*b*.

Figure 12:
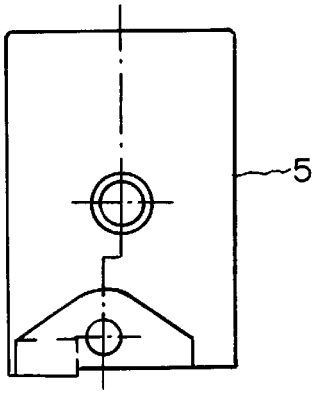
FIG. 12 is a plan view showing the cross slide of the inventive electromagnetically actuated lock.

FIG. 12 shows the cross slide 5 having, on the lower edge, a recess for the magnetic armature 7*a*.

Figure 13:
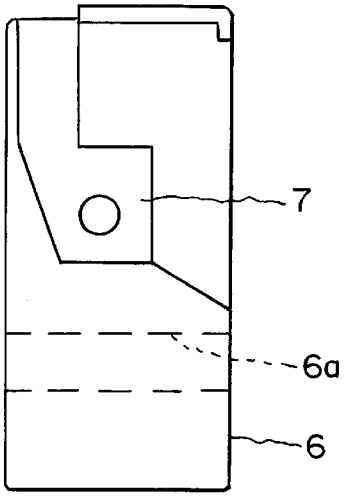
FIG. 13 is a plan view showing the locking slide of the inventive electromagnetically actuated lock.

FIG. 13 shows the locking slide 6 with turnway 6*a* and a recess for the electromagnet 7.

Figure 14:
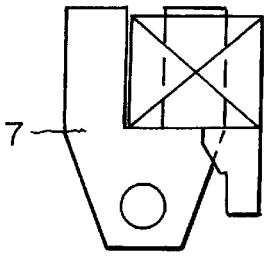
FIG. 14 is a plan view of the magnetic yoke with a coil.
Figure 15:
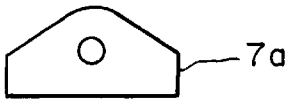
FIG. 15 is a plan view of the magnetic armature of the electromagnetically actuated lock of the invention.

Electromagnet 7, which comprises a magnetic yoke and a coil, is shown in FIG. 14, with an associated armature 7*a* being shown in FIG. 15.

Figure 16:
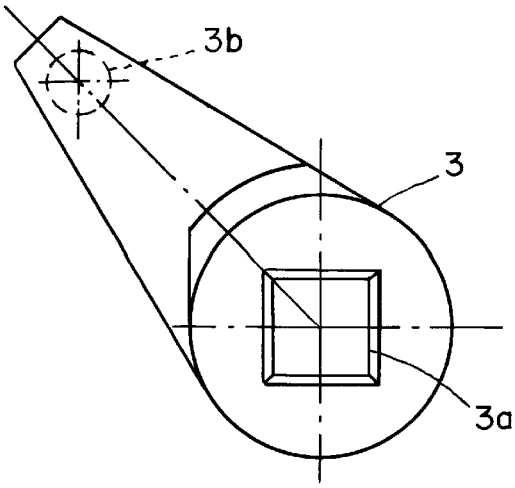
FIG. 16 is a prospective view of the swivel of the driving element of the bolt of the inventive lock; and, FIG. 17 is a plan view of a further preferred embodiment of the locking slide of the electromagnetically actuated lock of the present invention.

FIG. 16 shows the swivel 3 with a square hole 3*a* and pin 3*b* on the end of the jib engaging bolt 2.

Figure 17:
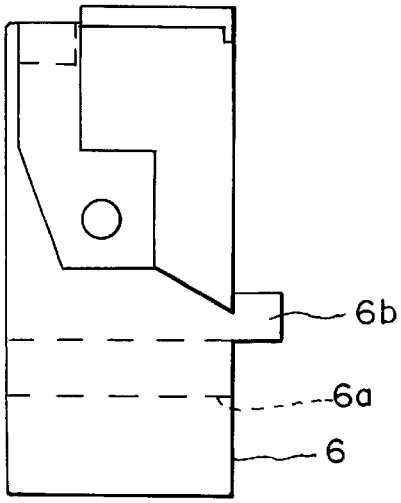

A preferred embodiment of locking slide 6 is shown in FIG. 17. Above turnway 6*a*, locking slide 6 has a lateral projection 6*b*, which retains the turnpin when the bolt is retracted. If locking slide 6 is installed in the lock, instead of the one shown in FIG. 13, the container, for example, for valuables, can be locked at any time, i.e., without any coded current pulse.

The scope of the present invention is not limited to the lock shown with the bolt drive via the swivel and handling means. It is possible to, additionally, install a tumbler lock mechanism, so that both a key and a coded current pulse are required. In this case, a double-bit key serves as the "handling means," which, in its "control path," both arranges the tumblers in their proper places and moves the control slide before a part of the key bit puts the bolt into motion.

In a further, preferred embodiment of the present invention, the inventive lock is shown as being supplemented by a double-bit lock mechanism, which is accommodated in a recess of the casing and which serves as an emergency opening system. The additional lock mechanism is used only when the user has forgotten the code, or lock combination, or when the coding system is defective.

The structure of the lock casing and bolt, in essence, permit the additional support of bascule bars in the left-third of the casing, such bars being driven by a pin 11 on bolt 2, as in FIG. 10.

The great advantage of the novel type of magnetic means utilized by the present invention resides in that only three slides are basically required, instead of locking and controlling levers with complicated control cams, with only one of the three slides having a control cam. The control slide 4, the cross slide 5, and the locking slide 6, which only perform linear movements, can be easily and precisely supported in recesses of the casing. In this manner, permanently reliable and precise functioning is achieved with relatively low manufacturing expenditure.

While only several embodiments of the present invention have been shown and described, it will be obvious to those skilled in the art that many modifications may be made to the present invention without departing from the spirit and scope thereof.

What is claimed is:

1. An electromagnetically actuated lock, comprising:

a lock bolt with a turnpin;

an electromagnet used as a retaining magnet, said electromagnet including controlling and locking means for locking or releasing said lock bolt;

a control slide moving via a control cam;

a locking slide having a turnway;

a cross slide coupled via said electromagnet with said locking slide; and, handling means for actuating said lock bolt and for driving said control slide moving via said control cam, said cross slide coupled via said electromagnet with said locking slide, so that the turnpin of said lock bolt immerses in the turnway of said locking slide.

2. The electromagnetically actuated lock according to claim 1, wherein said electromagnet includes a yoke and a coil arranged on said locking slide.

3. The electromagnetically actuated lock according to claim 1, further comprising a spring for biassing said cross slide in the direction of said locking slide.

4. The electromagnetically actuated lock according to claim 1, further comprising an additional spring of lesser strength than said spring, said additional spring engaging between said cross slide and said locking slide.

5. The electromagnetically actuated lock according to claim 1, wherein when said lock bolt is retracted, the turnpin exits from the turnway of said locking slide, so that said lock bolt is readily movable in the direction of locking.

6. The electromagnetically actuated lock according to claim 1, wherein when said lock bolt is retracted, the turnpin exits from the turnway of the locking slide, so that said locking slide drops into a locking position and extending of said lock bolt is only possible when an electric pulse is applied.

* * * * *